US005642584A

United States Patent [19]

Riggenbach

[11] Patent Number: 5,642,584

[45] Date of Patent: Jul. 1, 1997

[54] GUN SLING

[76] Inventor: Richard C. Riggenbach, Box 11, Bloomfield, Iowa 52537

[21] Appl. No.: 654,056

[22] Filed: May 28, 1996

[51] Int. Cl.[6] ..... F41C 23/02

[52] U.S. Cl. ..... 42/85; 42/94

[58] Field of Search ..... 42/85, 94

[56] References Cited

U.S. PATENT DOCUMENTS

| | | | |
|---|---|---|---|
| 4,249,686 | 2/1981 | Morwood | 224/150 |
| 4,361,258 | 11/1982 | Clark | 224/150 |
| 4,401,246 | 8/1983 | Dickinson et al. | 224/150 |
| 4,823,998 | 4/1989 | Johnson | 224/150 |
| 5,018,652 | 5/1991 | Holtzelaw, Jr. | 224/150 |
| 5,110,022 | 5/1992 | Dvoroznak et al. | 224/150 |
| 5,311,693 | 5/1994 | Underwood | 42/94 |

FOREIGN PATENT DOCUMENTS 8401094 1/1985 WIPO .

*Primary Examiner*—Charles T. Jordan
*Assistant Examiner*—Meena Chelliah
*Attorney, Agent, or Firm*—Gilbreth & Strozier; J. M. Gilbreth; Robert W. Strozier

[57] ABSTRACT

A sling for use with a fiream. The sling includes a rigid body having a pivotable connector front end, a releasable connector back end, and a firearm engagement section located between the front and back ends. The rigid body is shaped to form a loop for receiving a user's shoulder once the front end is affixed to the hand grip section and the back end is affixed to the butt section. Furthermore, the rigid body is shaped such that as the back end of the rigid body is released from the butt section and the rigid body is pivoted on the pivotable connector, the firearm engagement section is brought into contact with the firearm to allow the back end of the rigid body to be planted and thus support the firearm during firing.

16 Claims, 3 Drawing Sheets

GUN SLING

BACKGROUND OF THE INVENTION

1. Field of the Invention

The present invention relates to firearm slings for guns, rifles, shotguns, machine guns and other conventional types of firearms and to firearms utilizing such slings. In another aspect, the present invention relates to firearm slings for use with guns, rifles, shotguns, machine guns or other conventional types of firearms to securely hold such firearms to the user's body when the weapon is not in use. In even another aspect, the present invention relates to a firearm sling which provides support for such a firearm when aiming or firing. In still another aspect, the present invention relates to a firearm sling which provides a firm grip on the firearm as it is being aimed or fired.

2. Description of the Related Art

Typically, firearm slings consist of a soft or flexible material which attaches to the stock of a firearm to securely hold the gun, machine gun, rifle or shotgun to the user's body when the weapon is not in use.

A firearm carried about using the typical sling of a soft or flexible material, does not provide support for the gun, machine gun, rifle or shotgun when aiming or firing.

Numerous types of firearm slings exist in the prior art. However, these slings suffer from one or more limitations.

U.S. Pat. No. 3,948,432, issued Apr. 6, 1976 to Hathaway, discloses an elastically extensible resilient gun sling which includes two loops. The two loops can be manipulated around the user's shoulder, arm and torso as shown to provide a stable firing position. However, the gun sling disclosed in this patent is constructed of an extensible resilient material, such as rubber, that enables it to be extended from a length operative to hold the rifle in the carrying position. However, the Hathaway auxiliary gun sling utilizes an elastic rubber type material, and thus cannot be used as a supportive member during aiming or firing.

U.S. Pat. No. 4,511,010, issued Apr. 16, 1985 to Hightower, discloses a sling for a rifle, shotgun or the like and is designed such as to be quickly adjustable. The Hightower sling is formed of a web of material folded upon itself to define first, second and third web portions. As the Hightower sling for a rifle, shotgun or the like utilizes a flexible material, it cannot be used as a supportive member during aiming or firing.

U.S. Pat. No. 5,110,022, issued May 5, 1992 to Dvoroznak, discloses a flexible rifle sling of a fabric material, which also includes a cradle portion of a fabric-covered foam rib member. This cradle portion is designed to receive the hand grip portion of a rifle.

U.S. Pat. No. 5,282,558, issued Feb. 1, 1994 to Martinez, discloses a sling for a rifle or shotgun that frees the arm and hand for other uses while the gun is being carried. The Martinez sling includes a normal shoulder loop, and further includes a neck-encircling loop to prevent the shoulder loop from sliding off the user's shoulder. However, the Martinez rifle or shotgun sling utilizes a flexible type material, and thus cannot be used as a supportive member during aiming or firing.

U.S. Pat. No. 5,323,940, issued Jun. 28, 1994 to Hart, discloses a fall away gun sling attachment for a butt of a gun stock; however, the Hart fall away gun sling attachment utilizes a flexible type material, and thus cannot be used as a supportive member during aiming or firing.

European Patent Application No. 0 345 194, filed Jun. 4, 1989, discloses a gun sling assembly utilizing a flexible shoulder strap. Thus, it cannot be used as a supportive member during aiming or firing.

However, in spite of these advancements in the prior art, none of these prior art references disclose or suggest a firearm sling which can be used to carry the firearm and also be used to support the firearm when aiming or firing the weapon.

Thus, there is still a need in the art for an improved firearm sling not suffering from the limitations of the prior art.

There is another need in the art for a firearm sling that is suitable for both carrying a firearm and for supporting a firearm when aiming or firing.

These and other needs in the art will become apparent to those of skill in the art upon review of this specification, including its drawings and claims.

SUMMARY OF THE INVENTION

It is an object of the present invention to provide for a firearm sling for carrying a firearm.

It is another object of the present invention to provide for a firearm sling that is suitable for both carrying a firearm and for supporting a firearm when aiming or firing.

These and other objects of the present invention will become apparent to those of skill in the art upon review of this specification, including its drawings and claims.

According to one embodiment of the present invention, there is provided a firearm sling. This sling includes a rigid body having a front end, a back end, and a firearm engagement section located between the front and back ends. A releasable connector is located at the back end of the rigid body, and a pivotable connector is located at the front end of the rigid body. The rigid body is shaped to form a loop for receiving a user's shoulder once the front end is affixed to the hand grip section and the back end is affixed to the butt section.

Furthermore, the rigid body is shaped such that the back end of the rigid body is released from the butt section and the rigid body is pivoted on the pivotable connector, the firearm engagement section is brought into contact with the firearm to allow the back end of the rigid body to be planted and thus support the firearm during firing.

According to another embodiment of the present invention, there is provided a firearm with a sling, with the sling as described above.

BRIEF DESCRIPTION OF THE DRAWINGS

For the following FIGS., like numbers in different drawings refer to like members.

DETAILED DESCRIPTION OF THE INVENTION

The present invention will described by reference to FIGS. 1–6 in which like reference numbers refer to like members.

Figure 1:
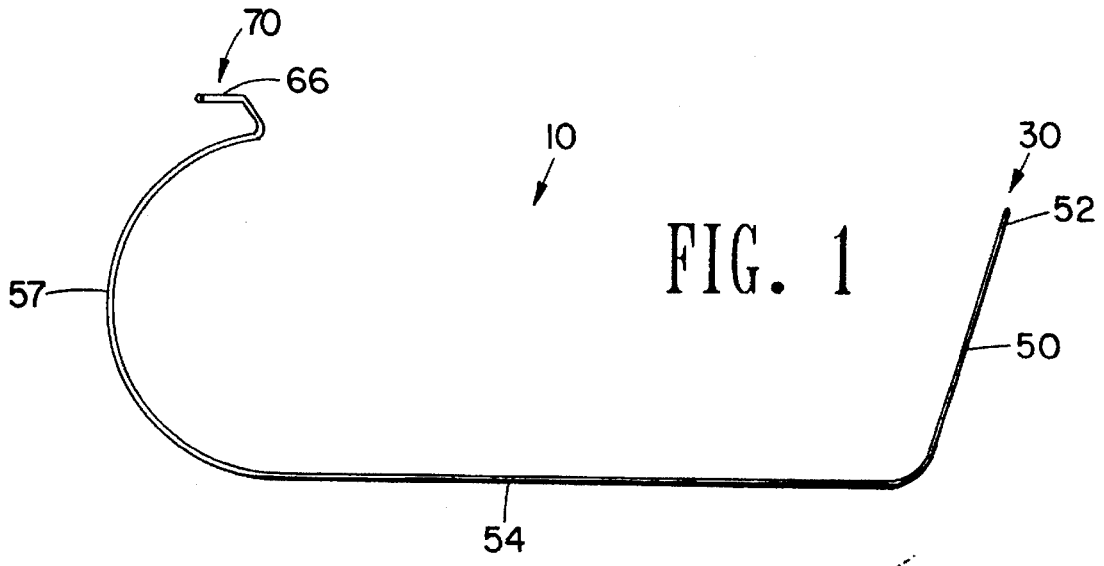
FIG. 1 is a side view of firearm sling stabilizer apparatus 10, which includes stock connector 70 at front section 10 for connection to the stock of a firearm, rear connector 30 at back section 52 for connection with the butt of a firearm, and first planting section 54 for planting firearm sling 10 against a support surface in order to provide a steady aiming of the firearm.

Referring first to FIG. 1, there is shown a side view of firearm sling stabilizer apparatus 10. In the embodiment shown, firearm sling stabilizer apparatus 10 is non-linear in shape, and includes stock connector 70 at front section 10 for connection to the stock of a firearm, rear connector 30 at back section 52 for connection with the butt of a firearm, and first planting section 54 for planting firearm sling 10 against a support surface in order to provide a steady aiming of the firearm. Firearm sling stabilizer apparatus 10 may further include second planting section 50 which is useful in a further embodiment of the present invention. Firearm sling stabilizer apparatus 10 may even further include a shoulder rest section 57 contoured to receive a user's shoulder.

Figure 3:
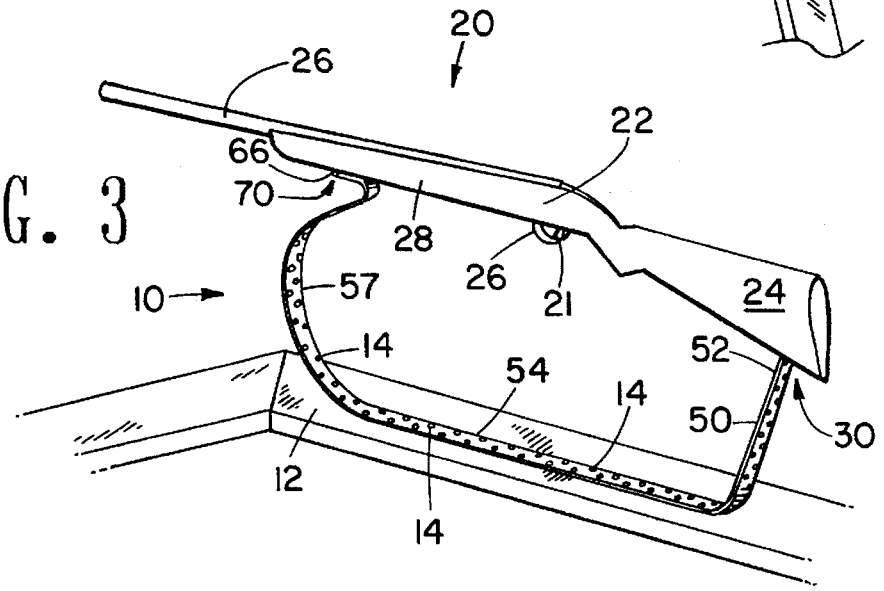
FIG. 3 is an illustration of firearm 20 supported by firearm sling stabilizer apparatus 10 on support surface 12.

Referring additionally to FIG. 3 there is shown an illustration of firearm 20 supported by firearm sling stabilizer apparatus 10 on support surface 12. As shown, firearm 20 is a rifle, but it must be understood that the present invention finds utility with many types of portable firearms and weapons, including, but not limited to guns, rifles, shotguns, machine guns, assault weapons, and launchers.

Rifle 20 generally includes barrel 26, trigger 21, trigger guard 26, and gun stock 22. Gun stock 22 generally includes forearm section 28 and butt section 24.

In the embodiment shown, planting section 54 is shown positioned directly on supporting surface 12. In the practice of the present invention, firearm sling stabilizer apparatus 10 may be used to support rifle 20 on a support surface 12 during the aiming and/or firing of the rifle. Firearm sling stabilizer apparatus 10 is shaped to support rifle 20 above and away from support surface 12, thus permitting the user's front positioned hand to have access to the bottom of stock forearm section 28 to allow for normal aiming and firing.

In this embodiment, firearm sling stabilizer 10 is further includes a multiplicity of holes 14, designed to provide a lightened sling 10, yet designed and positioned so that sling 10 will still provide suitable support during aiming and firing of rifle 20.

Figure 6:
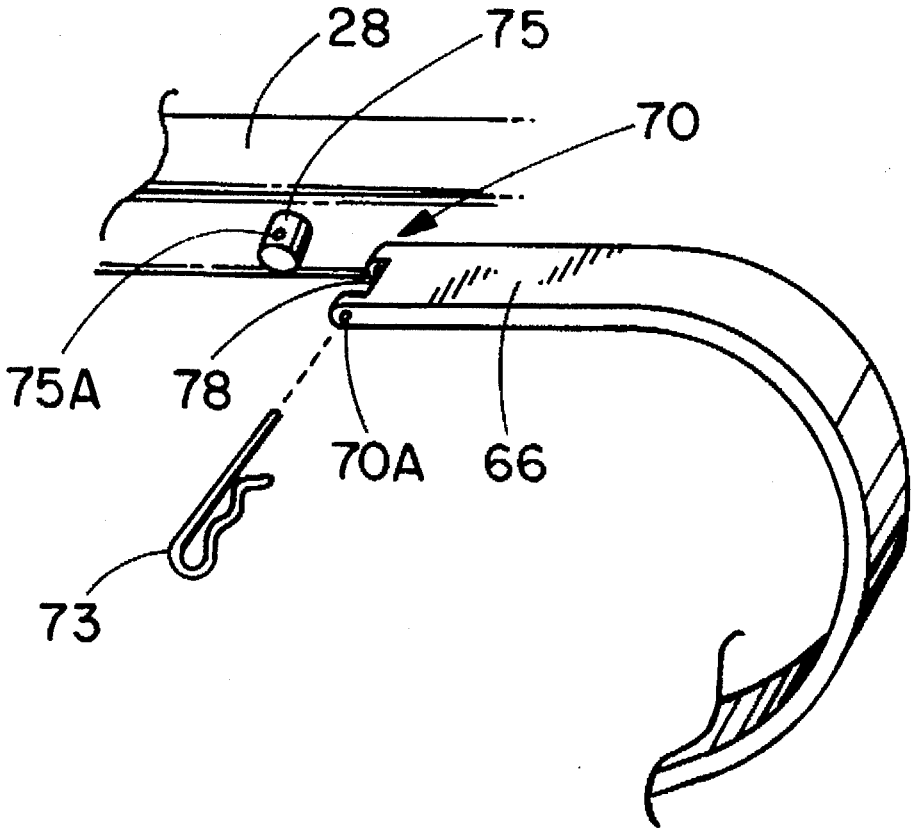
FIG. 6 is an enlarged view of front section 66 of sling 10 disengaged from stock forearm section 28.

Referring additionally to FIG. 6, there is shown an enlarged view of front section 66 of sling 10 disengaged from stock forearm section 28.

Front connector 70 and mating connector 75 may be any suitable types of connectors which will allow front section 66 to be securely fastened to stock forearm section 28.

In the embodiment shown, connector 70 includes groove 78, retaining pin slots 70A adapted to receive retaining pin 73, and retaining pin 73. Mating connector 75 includes retaining pin slots 75A for receiving retaining pin 73. Groove 78 and mating connector 75 are adapted such that mating connector 75 may be received into groove 78. With mating connector 75 positioned in groove 78, retaining pin slots 70A and 75A are aligned to permit retaining pin 73 to be inserted through retaining pin slots 70A and 75A thus secure front connector member 70 to mating connector 75, and thus ultimately to rifle 20.

Figure 2:
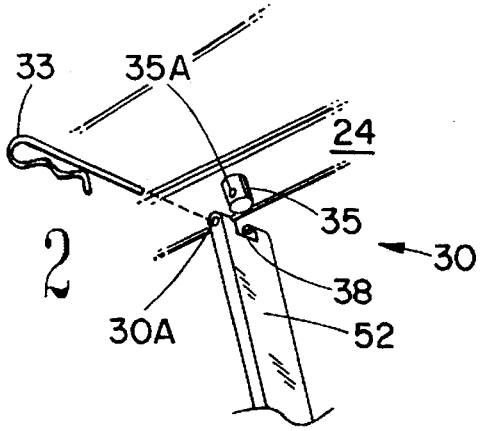
FIG. 2 is an exploded isometric view of rear connector member 30 of the present invention, showing sling back section 52, rifle butt section 24, back mating connector 35, and retaining pin 33.

Details of rear connector member 30 is shown by referring additionally to FIG. 2, which is an exploded isometric view of rear connector member 30 of the present invention, showing sling back section 52, rifle butt section 24, back mating connector 35, and retaining pin 33.

Rear connector member 30 further includes groove 38 in sling back section 52. Groove 38 is adapted to receive rear mating connector 35. Rear connector member 30 and rear mating connector 35 include retaining pin slots 30A and retaining pin slot 35A, respectively, which slots are adapted to receive retaining pin 33. With rear mating connector 35 positioned into groove 38, retaining pin slots 30A and 35A are aligned to permit retaining pin 33 to be inserted through retaining pin slots 30A and 35A to secure rear connector member 30 to rear mating connector 35, and thus ultimately to rifle 20.

For the embodiment of the present invention explained below, in which sling 10 is rotated to different positions, it is additionally necessary that rear connector 30 allow sling 10 to pivot or swing, to allow such movement.

Figure 4:
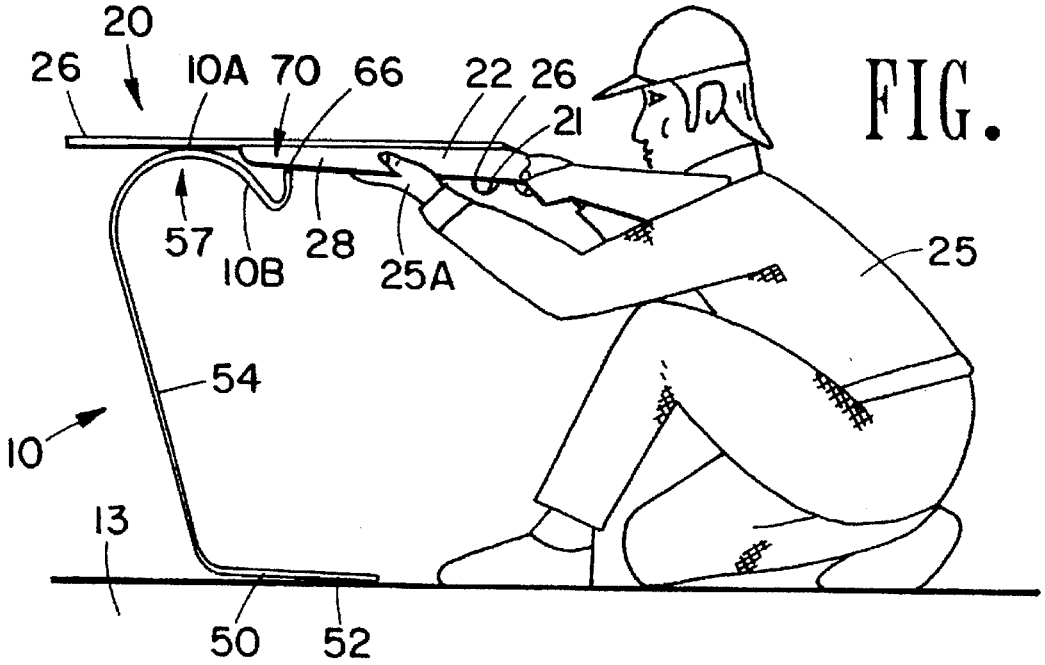
FIG. 4 is an illustration showing user 25 in a squatting position aiming rifle 20, which is supported by firearm sling stabilizer apparatus 10.

Referring now to FIG. 4, which is an illustration showing user 25 in a squatting position aiming rifle 20, which is supported by firearm sling stabilizer apparatus 10.

To position sling 10 in such an arrangement, retaining pin 33, inserted through retaining pin slots 30A and 35A to secure rear connector member 30 to rifle 20, is removed. Sling 10 is then pivoted at front connector 70 until sling 10 contacts rifle 20 at one or more contact points and second planting member 50 is planted upon a supporting surface 13. In the embodiment shown, sling 10 contacts barrel 26 at section 10A while user 25 aims or fires rifle 20. Shoulder rest section 57 is positioned against the bottom of barrel 26 in order to support barrel 26. While it is only necessary that sling 10 contact only one point on rifle 20, additional support and stability can be provided by using additional contact points, such as that provided by sling 10 contacting the bottom of forearm section 28 at section 10B to additionally balance and support rifle 20. Sling 10 may be optionally provided with grooves shaped to receive rifle 20.

It must be understood that while user 25 is shown squatting, user 25 may also stand, stood or be otherwise positioned, when sling 20 is in this position.

Figure 5:
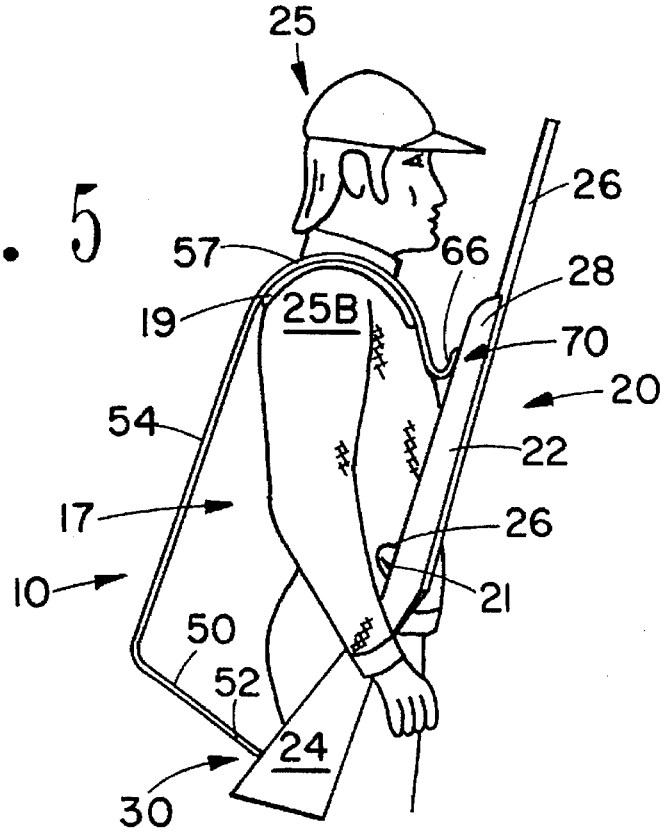
FIG. 5 is an illustration of user 25 in a standing position using firearm sling stabilizer apparatus 10 to transport rifle 20.

Referring additionally FIG. 5, there is provided an illustration of user 25 in a standing position using firearm sling stabilizer apparatus 10 to transport rifle 20.

In such a carrying position, sling 10 is rotated back in order to position rear connector member 30 into groove 38, with retaining pin slots 30A and 35A realigned to permit retaining pin 33 to be inserted through retaining pin slots 30A and 35A, to once again secure rear connector member 30 to rifle 20. Once both front connector 70 and rear connector 30 are connected to rifle 20, a loop 17 is formed for receiving the user's shoulder and arm. This wide loop 17 permits rapid removal of rifle 20 from shoulder 25B should the need for rapid firing occur.

Shoulder rest section 57 is positioned on shoulder 25B of user 25 and rifle 20 can be carried while the arms and hands of user 25 are freed for other uses. An optional shoulder pad 19 may be provided for comfort. Should pad 19 may be made of any suitable material that will pad shoulder 25B from sling 10.

Sling 10 of the present invention is generally made from any suitable material that will provide the necessary rigidity required to support the rifle during aiming and firing, and not be unduly heavy. Nonlimiting examples of suitable materials include metals, wood, plastics, and composite materials.

Sling 10 may be formed from suitable materials using forming techniques known for those materials.

The present invention finds utility at least for providing convenient apparatus for the transporting of a firearm, and for providing a convenient apparatus for supporting a firearm during aiming and firing.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A sling for use with a firearm having a hand grip section and butt section, the sling comprising:

a nonlinear rigid body having a front end, a back end, and a firearm engagement section located along the body between the front and back ends;

a releasable connector at the back end of the rigid body;

a pivotable connector at the front end of the rigid body;

wherein the rigid body is shaped to form a loop for receiving a user's shoulder once the front end is affixed to the hand grip section with the pivotable connector and the back end is affixed to the butt section with the releasable connector, and wherein the rigid body is shaped such that as the back end of the rigid body is released from the butt section and the rigid body is pivoted on the pivotable connector, the firearm engagement section can be brought into contact with the firearm to allow the back end of the rigid body to be planted and thus support the firearm during firing.

2. The sling of claim 1 further comprising a shoulder engagement section located on the body between the front end and the back end for receiving the user's shoulder.

3. The sling of claim 2 wherein the shoulder engagement section is padded.

4. The sling of claim 1 wherein the releasable connector comprises slots at the back end of the body aligned with a first slot on the firearm, with a first retaining pin inserted through the slots, and wherein the pivotable connector comprises slots at the front end of the body aligned with a second slot on the firearm, with a second retaining pin inserted through the pivotable connector slots and the second slot.

5. The sling of claim 4 wherein the rigid body comprises a material selected from the group of materials consisting of metal, wood, plastic, and composites.

6. The sling of claim 5 further comprising a shoulder engagement section located on the body between the front end and the back end for receiving the user's shoulder, and wherein the releasable connector comprises slots at the back end of the body aligned with a first slot on the firearm, with a first retaining pin inserted through the slots, and wherein the pivotable connector comprises slots at the front end of the body aligned with a second slot on the firearm, with a second retaining pin inserted through the pivotable connector slots and the second slot.

7. The sling of claim 6 wherein the rigid body comprises metal.

8. The sling of claim 7 wherein the rigid body defines a series of slots.

9. A firearm comprising:

a barrel;

a stock connected to the barrel, comprising a hand grip section and butt section;

a nonlinear rigid body having a front end, a back end, and a firearm engagement section located along the body between the front and back ends;

a releasable connector at the back end of the rigid body;

a pivotable connector at the front end of the rigid body;

wherein the rigid body is shaped to form a loop for receiving a user's shoulder once the front end is affixed to the hand grip section with the pivotable connector and the back end is affixed to the butt section with the releasable connector, and wherein the rigid body is shaped such that as the back end of the rigid body is released from the butt section and the rigid body is pivoted on the pivotable connector, the firearm engagement section can be brought into contact with the firearm to allow the back end of the rigid body to be planted and thus support the firearm during firing.

10. The firearm of claim 9 further comprising a shoulder engagement section located on the body between the front end and the back end for receiving the user's shoulder.

11. The firearm of claim 10 wherein the shoulder engagement section is padded.

12. The firearm of claim 9 wherein the releasable connector comprises slots at the back end of the body aligned with a first slot on the firearm, with a first retaining pin inserted through the slots, and wherein the pivotable connector comprises slots at the front end of the body aligned with a second slot on the firearm, with a second retaining pin inserted through the pivotable connector slots and the second slot.

13. The firearm of claim 12 wherein the rigid body comprises a material selected from the group of materials consisting of metal, wood, plastic, and composites.

14. The firearm of claim 13 further comprising a shoulder engagement section located on the body between the front end and the back end for receiving the user's shoulder, and wherein the releasable connector comprises slots at the back end of the body aligned with a first slot on the firearm, with a first retaining pin inserted through the slots, and wherein the pivotable connector comprises slots at the front end of the body aligned with a second slot on the firearm, with a second retaining pin inserted through the pivotable connector slots and the second slot.

15. The sling of claim 14 wherein the rigid body comprises metal.

16. The sling of claim 15 wherein the rigid body defines a series of slots.

* * * * *